United States Patent [19]

Foss

[11] Patent Number: 4,693,928

[45] Date of Patent: Sep. 15, 1987

[54] POROUS, FIBROUS STRUCTURES WITH THERMOPLASTIC FLUOROCARBON COATING AND METHOD OF MAKING

[75] Inventor: Warren M. Foss, Glen Cove, N.Y.

[73] Assignee: Pall Corporation, Glen Cove, N.Y.

[21] Appl. No.: 827,529

[22] Filed: Feb. 10, 1986

[51] Int. Cl.[4] ..... B32B 5/06

[52] U.S. Cl. ..... 428/236; 427/195; 427/267; 428/288; 428/290; 428/421; 428/422

[58] Field of Search ..... 428/236, 288, 290, 421, 428/422; 427/195, 269

[56] References Cited

U.S. PATENT DOCUMENTS

| | | | |
|---|---|---|---|
| 2,712,509 | 7/1955 | Biefeld | 117/126 |
| 3,928,703 | 12/1975 | Cook | 428/255 |
| 4,131,711 | 12/1978 | Attwood | 428/332 |
| 4,169,754 | 10/1979 | Perrotta | 156/187 |
| 4,272,294 | 6/1981 | Juanarajs | 106/99 |
| 4,507,337 | 3/1985 | Yamaguchi et al. | 427/269 |
| 4,523,995 | 6/1985 | Pall et al. | 210/504 |

*Primary Examiner*—Marion C. McCamish

*Attorney, Agent, or Firm*—Leydig, Voit & Mayer

[57] ABSTRACT

A process for making a porous, fibrous structure coated with a fluorocarbon polymer comprising (1) preparing an aqueous slurry of inorganic fibers and fluorocarbon polymer; (2) precipitating the fluorocarbon polymer onto the inorganic fibers by lowering the pH of the slurry to an acidic value and adding a cationic flocculant; (e) forming a porous, fibrous structure from the resulting slurry; and (4) drying and heat treating the resulting structure. The porous, fibrous structure comprises inorganic fibers the surfaces of which are coated with a precipitated fluorocarbon polymer with the fibers secured to one another at cross-over points by the fluorocarbon polymer thereby providing structural integrity.

21 Claims, No Drawings

POROUS, FIBROUS STRUCTURES WITH THERMOPLASTIC FLUOROCARBON COATING AND METHOD OF MAKING

TECHNICAL FIELD

This invention relates to porous, fibrous structures coated with fluorocarbon polymer and methods for their manufacture. More particularly, this invention is directed to filter structures comprising glass fiber structures coated with fluorocarbon polymer.

BACKGROUND ART

Fibrous filter media are produced in a wide variety of forms and are employed in many diverse applications. For many applications, these media must be able to perform at high efficiency over an extended period of time when exposed to high temperatures and corrosive fluids (e.g., in the processing of aramid fibers, a slurry of the fibers in hot concentrated sulfuric acid must be filtered to effectively separate the fibers from the acid by a filter medium which must maintain its integrity in service over an extended period of time). Thus, it is very important that both the fibers and the binder resin in the fibrous media be capable of withstanding this type of potentially highly destructive environment over the useful life of the filter.

When the environment requires the use of strong acids or bases and/or requires continuous use at temperatures in excess of 350° F, the only resin types that can adequately meet these stringent requirements are fluorocarbon polymers. Glass fibers are often used in such media since, while they are susceptible to attack in strongly acidic or alkaline environments, their integrity can generally be maintained over a reasonable time. To the extent that their integrity could be extended, this would be desirable.

Past efforts to impregnate fibrous structures with fluorocarbon resins have been only partially successful. The prior methods generally involve a dip coat post impregnation technique. This technique typically leads to a non-uniform sandwich-type structure with the resin coating primarily on the top and bottom surfaces of the fibrous structure with limited or no bonding throughout the body of the structure resulting in limited structural integrity.

The subject invention is directed to a method for preparing porous, fibrous structures which overcomes the problem of non-uniform dispersion of the fluorocarbon resin and to the resulting structures which have a substantially uniform coating of the fluorocarbon resin throughout the structure. It is further directed to extending the life of fibrous glass structures.

DISCLOSURE OF THE INVENTION

This invention is directed to a process for making a porous fibrous structure coated with a fluorocarbon polymer comprising:

(1) preparing an aqueous slurry of inorganic fibers and a fluorocarbon polymer;

(2) precipitating the fluorocarbon polymer onto the inorganic fibers by lowering the pH of the slurry to an acidic value and adding a cationic flocculant;

(3) forming a porous, fibrous structure from the resulting slurry; and (4) drying and heat treating the resulting structure.

The preferred inorganic fibers are glass microfibers Preferaby, the pH is lowered before the cationic flocculant is added although the flocculant can be added prior to, or simultaneously with, the lowering of the pH. The resultant porous, fibrous structure comprises inorganic fibers, the surfaces of which are coated with the precipitated fluorocarbon polymer and secured or bonded to each other at crossover points by the fluorocarbon polymer throughout the structure thereby providing structural integrity.

If the fibrous matrix structure must be handled in any way or removed from the substrate prior to heat treating, i.e., melt bonding of the fluorocarbon polymer or resin binder, then it is desirable to admix with the aqueous fiber slurry a fugitive binder to impart sufficient strength to the matrix to allow handling prior to heat treating the fluorocarbon polymer. The admixing of the fugitive binder can be done prior to, simultaneously with, or subsequent to the addition of the fluorocarbon polymer emulsion. When the fibrous matrix structure is to be secured to a substrate, the fibrous matrix comprising the fluorocarbon polymer, fibers, and the fugitive binder is dried to provide sufficient strength to allow handling following which the structure is impregnated with a dilute emulsion of fluorocarbon polymer prior to heat treating. This post-drying impregnation step provides good adhesion of the fibrous matrix structure to the substrate to form the desired composite structure.

BEST MODE FOR CARRYING OUT THE INVENTION

A variety of inorganic fibers may be used in the subject invention. Preferred materials are glass and titanate microfibers which have mean fiber diameters of from about 0.1 micrometer up to about 10 micrometers, although fibers lying outside this range can also be used. The median length of the glass microfibers to diameter ratio (aspect ratio) will generally be in the range of from 500 to 1,000. Glass microfibers of this type are available from commercial manufacturers such as PPG Industries, Johns-Mansville Inc., and Owens-Corning Fiberglass Corp., as well as other manufacturers. Sources for titanate fibers include Otsuka Chemical Company, Ltd. (Japan) and E. I. DuPont de Nemours and Company.

The fluorocarbon polymer may be selected from a number of well known materials. The polymer must be resistant to high temperatures and aggressive chemical environments and be capable of providing adequate bonding between the fibers upon heat treating. The fluorocarbon polymers which are suitable for use in accordance with the present invention include those polymers which are thermoplastic and are capable of flowing and bonding the glass fiber matrix upon exposure to a controlled thermal environment, i.e., the heat treatment in accordance with the present invention. Ideally, the preferred thermoplastic polymer will produce little or no webbing in the matrix pore structure along with no increase in clean pressure drop and will impart good strength. Typical preferred thermoplastic fluorocarbon polymers include:

(1) PFA—a copolymer of tetrafluoroethylene and perfluorinated vinyl ether (E. I. DuPont de Nemours and Company) and (2) FEP 120—a copolymer of tetrafluoroethylene and hexafluoropropylene (E. I. DuPont de Nemours and Company).

By contrast, other fluorocarbon polymers, such as TFE (a polymer of tetrafluoroethylene (E. I. DuPont de Nemours and Company) which sinter rather than flow when heated to the appropriate temperature are not as desirable. This type of fluorocarbon polymer does not provide the desired protective uniform coating over the entire fiber surface. Although polymers which sinter may be employed when a protective coating is not desired, as long as sufficient fiber-to-fiber binding is provided, enhanced bonding and concomitant structural integrity generally will be obtained by using thermoplastic fluorocarbon polymers.

The properties of fluorocarbon polymers, and methods for making them, are well known in the art.

They are also commercially available, e.g., as already noted from E. I. DuPont de Nemours and Company as well as from other companies such as ICI Industries and Allied Corporation.

The fluorocarbon polymer is preferably and most easily utilized in emulsion form. The concentration of the fluorocarbon polymer in the carrier medium can vary provided that the composition is easily handled. It typically can be admixed with the aqueous slurry of inorganic fibers as received from the supplier or it may be diluted prior to use.

The amount of fluorocarbon polymer to be admixed with the inorganic fibers typically is an amount of from about 5 to about 25 weight percent, based on the weight of the inorganic fibers. Amounts below 5 weight percent may be used, however, when less bonding is required. Generally, amounts greater than 25 weight percent will lead to webbing, that is, the formation of polymer films from fiber to fiber in areas not immediately adjacent those areas in which fibers contact each other. Thus, it is generally desirable not to exceed an upper limit of about 25 weight percent for good bonding. (Weight percents referred to here are for fluorocarbon polymer solids and dry inorganic fibers.)

Precipitating The Fluorocarbon Polvmer:

The pH of the glass fiber slurry with the admixed fluorocarbon polymer emulsion should preferably be lowered to an acidic pH value of at least 3 and more preferably to a pH value of approximately 2. If the pH value exceeds 4, the recovery of the fluorocarbon polymer is low and undesirable flocculation of the fiber slurry can occur resulting in poorer efficiency ratings of the formed structure. The pH may be lowered to the desired acidic range by the addition of any suitable acid, e.g., concentrated mineral acids such as hydrochloric, nitric and sulfuric.

Fluorocarbon polymer emulsions are generally stabilized with anionic surfactants, hence flocculation of these emulsions to effect polymer retention in a fibrous medium is best achieved by the addition of suitable cationic flocculant. A common class of cationic flocculants is the polyamines. An effective flocculant in this class is NALCO 634 (available from Nalco Chemical Co., Oak Brook, Ill.).

Suitable flocculants are commercially available. Their properties and compositions are well known, having been disclosed, e.g., in H. Hamza, INDEX OF COMMERCIAL FLOCCULANTS; J. Picard, 1974 *Canmet Report* 77-78 (Canada Centre for Mineral and Energy Technology, Canada, 1975); and in R. Booth et al, *Ind. Min. J.* (Special Issue) 335 (1957).

Generally, small amounts of flocculant, e.g., a flocculant/fluorocarbon polymer weight ratio of about 1:50 to about 1:200, more preferably from about 1:75 to 1:125, and typically about 1:100, is sufficient to initiate precipitation. The minimum amount required to effect precipitation is preferable in that no benefit is obtained by using more and using an excessive amount can lead to a redispersion of the fluorocarbon polymer by reversing the surface charge.

Fibrous structures in accordance with this invention may be formed by conventional felting techniques well known in the art of paper making and fibrous media manufacturing. For example, a mixture of a well dispersed water diluted slurry of fibers and the fluorocarbon polymer is laid down on an appropriate screen or substrate and vacuum is applied to form the porous, fibrous structure which is thereafter heat treated.

The formed, porous, fibrous structure is dried and heat treted. For thermoplastic fluorocarbon polymers, the temperature and deviation of the heat treatment should be such that the fluorocarbon polymer is allowed to melt and flow, thereby substantially completely covering the surfaces of the glass fibers. For example, when fluorinated ethylene-propylene polymers are used, the heat tretament will be typically conducted at from about 550° to 750° F. for from about 45 seconds to about 20 minutes depending on the fluorocarbon resin employed and the temperature chosen. For example, with FEP 120 fluorocarbon polymer resin, melt flow can be obtained above 550° F. and good melt flow characteristics are obtained in the 550°–650° F. range. Thus, at about 575° F., heat treatment for about 20 minutes is sufficient to promote good resin flow and bonding. With PFA, good melt flow occurs above 600° F. Thus, at 620° F., heat treatment for 20 minutes effects good melt flow and bonding. If a higher cure temperature is employed for FEP or PFA, e.g., 720° F., then a shorter cure period of from about 1 to about 3 minutes can be employed for good melt flow and bonding Melt flow can not be achieved with TFE fluorocarbon polymers or resins since they only bond by sintering and require higher bonding temperatures. Thus, with TFE a minimum cure temperature of about 700° F. must be employed. However, at 750° F. a short cure period of 45 seconds to approximately 3 minutes will be sufficient to effect a good cure.

The structures in accordance with this invention have good structural integrity, resulting from the method of formation. Specifically, when a thermoplastic fluorocarbon polymer is precipitated in the manner disclosed, it substantially uniformly coats the fibers in the slurry. Accordingly, when the coated fibers are formed into a porous fibrous structure, e.g., into a filter sheet, by laydown onto a foraminous screen by conventional techniques, and then dried and heat treated, the fluorocarbon polymer, which is substantially uniformly distributed throughout the structure, on heat treatment bonds the fibers to each other at crossover contact points throughout the structure thereby providing the structure with good structural integrity. Typically, a porous, fibrous structure in accordance with this invention in sheet form will have dry tensile strengths of from about 0.5 to about 5 pounds per inch, more preferably from about 1 to about 2 pounds per inch.

If the fibers are to be bonded to a porous substrate to form a composite structure, the substrate, like the fibers, should be chemically and thermally stable under the conditions required for heat treating the fluorocarbon polymer. Woven fiberglass is a preferred substrate for many applications.

When the fibers are to be laid down on a substrate such as a woven fiberglass cloth to form a composite structure, a fugitive binder preferably is admixed with the fiber slurry prior to the addition of the fluorocarbon polymer. After laydown on the substrate and upon drying at a relatively low temperature, the fugitive binder provides green strength, i.e., temporary binding of the fibers to each other, to allow the structure to be handled. During the subsequent relatively high temperature heat treating of the fluorocarbon polymer, the fugitive binder will decompose and, in large measure, be removed from the structure.

Materials useful as fugitive binders are well known in the art. One commonly employed group includes copolymers of ethylene/vinyl acetate (e.g., 100 HS resin available from Air Products Inc., Allentown, Pa.). Only the minimum amount of fugitive binder required to facilitate handling during processing should be used. Generally, from about 5 to 10 weight percent based on the weight of the inorganic fibers is sufficient.

When the fibers are to be bonded to a substrate such as a woven glass cloth to form a composite structure, the composite structure formed by laydown of the fibers on the substrate is dried so that the fugitive binder provides integrity for the glass fibers following which the composite structure, is post impregnated by, e.g., dipping into a diluted fluorocarbon polymer emulsion to saturate the composite structure. The impregnating emulsion preferably comprises the same fluorocarbon polymer used for bonding the fiber matrix or web. The fluorocarbon polymer should be present in the impregnating emulsion in an amount sufficient to thoroughly coat the composite structure. Generally, an impregnating emulsion containing from about 5 to about 10 weight percent of the fluorocarbon polymer will suffice.

The invention will be better understood by reference to the following Examples which are offered by way of illustration.

EXAMPLES

Example 1

A fluorocarbon polymer coated glass fiber structure or web was prepared by the following method:

(1) A mixture of short glass microfibers, i.e., from 300 to 1,900 micrometers in length and having diameters ranging from about 0.3 micrometer to about 4 micrometers, and water was formed into a well dispersed aqueous glass fiber slurry by beating for one hour in a Cowles mixer. The slurry as formed contained 8 grams of glass fibers per liter. After formation, the slurry was diluted to a concentration of 4 grams of glass fibers/-liter;

(2) concentrated (54%) fluorinated ethylene/propylene polymer emulsion (FEP 120, obtained from E. I. DuPont de Nemours Company) was thoroughly mixed into the slurry in an amount such that the FEP 120 solids were present in an amount equal to 15 weight percent based on the weight of the glass microfibers;

(3) the pH was then adjusted to about 2 by adding concentrated HCL;

(4) a cationic polyamine flocculant (NALCO 634, obtained from Nalco Chemicals Co.) diluted to 1% concentration was added to the pH adjusted slurry with mixing in an amount such that the NALCO 634/FEP 120 solids ratio was approximately 1:100 to cause precipitation of the polymer and coating of the fibers;

(5) a fibrous structure or web of the resulting coated glass fibers was laid down in an amount of 5.0 grams/-foot$^2$ of the coated glass fibers and dried at about 220° F.; and (6) the fibrous structure was heat treated at 620° F. for ten minutes.

Example 2

A porous, glass fiber structure or web supported on a porous glass fiber cloth substrate was prepared by the procedure described in Example 1 except that:

(1) a sufficent amount of an ethylene/vinyl acetate copolymer resin emulsion (100 HS, obtained from Air Products, Inc.) as a fugitive binder was admixed into the glass microfiber slurry (prior to the addition of FEP 120 emulsion) to provide 10 weight percent 100 HS resin solids based on the weight of the glass microfibers;

(2) after adjustment of the pH to about 2 and addition of the flocculant to precipitate the fluorocarbon polymer coating of the fibers, the flocculated slurry was laid down on the glass fiber cloth (substrate) to form a composite structure and dried at a temperature of about 220° F. for about 15 minutes; and (3) the dried composite structure in which the glass fibers were secured to each other by the fugitive binder was impregnated with FEP 120 by dipping it into an aqueous emulsion containing 10% FEP 120 prior to the heat treating step.

Example 3

A fluorocarbon coated glass fiber web was prepared by the procedure of Example 1 except that the fluorocarbon polymer was PFA (obtained from E. I. DuPont de Nemours and Company).

Example 4

A fluorocarbon coated glass fiber structure supported on a glass fiber cloth substrate was prepared as described in Example 2 except that the fluorocarbon resin was PFA.

Example 5

A fluorocarbon coated glass fiber web was prepared by the procedure of Example 1 except that the fluorocarbon polymer was PTFE (obtained from E. I. DuPont de Nemours and Company) and the sample was cured at 750° F. for 5 minutes.

Example 6

A fluorocarbon coated glass fiber web supported on a glass fiber woven cloth substrate similar to Example 4 was prepared except that the fluorocarbon resin was PTFE and the post impregnation cure was carried out at 750° F. for 5 minutes.

After curing, the porous, glass fiber structures described in Examples 1–4 were found to have good structural integrity. Photomicrographs of the structures showed substantially complete coating of the individual glass fibers in the laid down structure with minimal webbing, and, in those cases where a composite structure was formed (Examples 2 and 4) good adhesion of the formed web or structure to the substrate. As a result of the substantially complete coating of the individual glass fibers, the integrity of the structure was extended. The use of PTFE in Examples 5 and 6 provided structures with good structural integrity albeit the glass fibers were not substantially completely covered with the fluorocarbon polymer as in Examples 1–4.

I claim:

1. A process for making a porous, fibrous structure coated with a fluorocarbon polymer which comprises:

(1) preparing an aqueous slurry of inorganic fibers and thermoplastic fluorocarbon polymer;
(2) precipitating the thermoplastic fluorocarbon polymer onto the inorganic fibers by lowering the pH of the slurry to an acidic value and adding a cationic flocculant;
(3) forming a porous, fibrous structure from the inorganic fibers onto which the fluorocarbon polymer has been precipitated;
(4) drying; and
(5) heating to the melt flow temperature of the thermoplastic fluorocarbon polymer, thereby causing said thermoplastic fluorocarbon polymer to flow and substantially completely coat the inorganic fibers.

2. The process of claim 1 wherein the inorganic fibers comprise glass microfibers.

3. The process of claim 1 wherein the fluorocarbon polymer is a copolymer of tetrafluoroethylene and hexafluoropropylene or a copolymer of tetrafluoroethylene and perfluorinated vinyl ether.

4. The process of claim 3 wherein the fluorocarbon polymer is in the form of an emulsion.

5. The process of claim 1 wherein the pH is lowered to about 4 or lower.

6. The process of claim 1 wherein the pH is lowered to about 3 or lower.

7. The process of claim wherein the pH is lowered to about 2 or lower.

8. The process of claim 7 wherein the amount of said fluorocarbon polymer in said aqueous slurry in step (1) of claim 1 is from about 5 to about 25 weight percent based on the weight of said inorganic fibers in said aqueous slurry.

9. A porous fibrous structure comprising fibers having a precipitated, thermoplastic fluorocarbon polymer coating substantially completely covering the fibers, the degree of fiber-to-fiber bonding being substantially uniform throughout said structure.

10. The porous, fibrous structure of claim 9 wherein said inorganic fibers are glass.

11. The porous, fibrous structure of claim 10 wherein said fluorocarbon polymer is a copolymer of tetrafluoroethylene and perfluorinated vinyl ether.

12. The porous, fibrous structure of claim 10 wherein said fluorocarbon polymer is a copolymer of tetrafluoroethylene and hexafluoropropylene.

13. A composite structure comprised of (1) a porous, fibrous structure of inorganic fibers substantially completely covered with a precipitated, thermoplastic fluorocarbon polymer, said fibers secured to one another at contact ponts by the precipitated fluorocarbon polymer and (2) a porous substrate secured to said porous, fibrous structure with a heat treated fluorocarbon polymer.

14. The composite structure of claim 13 wherein the fluorocarbon polymer used to secure said substrate to said porous, fibrous structure is the same fluorocarbon polymer as is the precipitated fluorocarbon polymer coating the inorganic fibers of said porous, fibrous structure.

15. The composite structure of claim 14 wherein said substrate is woven fiberglass.

16. The composite structure of claim 15 wherein said fluorocarbon polymer is a copolymer of tetrafluoroethylene and perfluorinated vinyl ether.

17. The composite structure of claim 15 wherein said fluorocarbon polymer is a copolymer of tetrafluoroethylene and hexafluoropropylene.

18. A process for making a fluorocarbon polymer-bonded, porous, composite structure which comprises:
(1) preparing an aqueous slurry of inorganic fibers, fugitive binder, and thermoplastic fluorocarbon polymer;
(2) precipitating the thermoplastic fluorocarbon polymer onto the inorganic fibers by lowering the pH of the slurry to an acidic value and adding a cationic flocculant;
(3) forming a porous, fibrous structure from the inorganic fibers onto which the fluorocarbon polymer has been precipitated by laying the floculated slurry down on a porous substrate to form a composite structure;
(4) drying the composite structure;
(5) impregnating the dried composite structure with an aqueous based fluorocarbon polymer composition;
(6) drying; and
(7) heating to the melt flow temperature of the thermoplastic fluorocarbon polymer, thereby causing said thermoplastic fluorocarbon polymer to flow and bond the inorganic fiber to the porous substrate and substantially completely coat the inorganic fibers.

19. The process of claim 18 wherein said aqueous based fluorocarbon polymer composition comprises a fluorinated ethylene-propylene polymer.

20. The process of claim 18 wherein said substrate comprises a woven glass fiber cloth.

21. The process of claim 18 wherein said fugitive binder is selected from the group comprising copolymers of ethylene/vinyl acetate and epoxy/phenolic resins.

* * * * *